US009558736B2

(12) United States Patent
Patil et al.

(10) Patent No.: US 9,558,736 B2
(45) Date of Patent: Jan. 31, 2017

(54) VOICE PROMPT GENERATION COMBINING NATIVE AND REMOTELY-GENERATED SPEECH DATA

(71) Applicant: Bose Corporation, Framingham, MA (US)

(72) Inventors: Naganagouda Patil, Ashland, MA (US); Sanjay Chaudhry, Marlborough, MA (US)

(73) Assignee: BOSE CORPORATION, Framingham, MA (US)

( * ) Notice: Subject to any disclaimer, the term of this patent is extended or adjusted under 35 U.S.C. 154(b) by 120 days.

(21) Appl. No.: 14/322,561

(22) Filed: Jul. 2, 2014

(65) Prior Publication Data

US 2016/0005393 A1 Jan. 7, 2016

(51) Int. Cl.

| | |
|---|---|
| ***G10L 13/00*** | (2006.01) |
| ***G10L 25/00*** | (2013.01) |
| ***G10L 21/00*** | (2013.01) |
| ***G10L 13/04*** | (2013.01) |
| ***G10L 13/08*** | (2013.01) |
| ***G10L 13/027*** | (2013.01) |

(52) U.S. Cl.

CPC ..... *G10L 13/043* (2013.01); *G10L 13/027* (2013.01); *G10L 13/04* (2013.01); *G10L 13/08* (2013.01)

(58) Field of Classification Search

CPC ..... G10L 13/00; G10L 13/027; G10L 13/08; G10L 13/02; G10L 13/043; G10L 13/033; G10L 15/30; G10L 13/04; G06F 3/16; H04M 2250/02; H04N 21/233; H04N 21/42222

USPC ..... 704/258, 260, 261, 270, 275

See application file for complete search history.

(56) References Cited

U.S. PATENT DOCUMENTS 5,500,919 A * 3/1996 Luther ..... G10L 13/00 704/260
5,758,318 A * 5/1998 Kojima ..... G10L 15/22 704/246

(Continued)

FOREIGN PATENT DOCUMENTS

EP 1471499 A1 10/2004
EP 1858005 A1 11/2007

OTHER PUBLICATIONS

International Search Report and Written Opinion of the International Searching Authority mailed Sep. 15, 2015 for PCT/US2015/038609, 10 pp.

*Primary Examiner* — Edgar Guerra-Erazo
(74) *Attorney, Agent, or Firm* — Patterson + Sheridan, LLP

(57) ABSTRACT

An electronic device includes a processor and a memory coupled to the processor. The memory stores instructions that, when executed by the processor, cause the processor to perform operations including determining whether a text prompt received from a wireless device corresponds to first synthesized speech data stored at the memory. The operations include, in response to a determination that the text prompt does not correspond to the first synthesized speech data, determining whether a network is accessible. The operations include, in response to a determination that the network is accessible, sending a text-to-speech (TTS) conversion request to a server via the network. The operation further include, in response to receiving second synthesized speech data from the server, storing the second synthesized speech data at the memory.

20 Claims, 4 Drawing Sheets

(56) References Cited

U.S. PATENT DOCUMENTS

| | | | | |
|---|---|---|---|---|
| 6,604,077 | B2 * | 8/2003 | Dragosh | G10L 15/30 704/243 |
| 7,414,925 | B2 * | 8/2008 | Carro | G06F 3/04886 369/29.01 |
| 7,454,346 | B1 * | 11/2008 | Dodrill | G10L 13/047 704/258 |
| 7,483,834 | B2 * | 1/2009 | Naimpally | G10L 13/00 704/258 |
| 8,116,438 | B2 * | 2/2012 | Carro | G06F 3/04886 379/88.04 |
| 8,468,569 | B2 * | 6/2013 | Osaki | H04N 21/2387 725/88 |
| 8,515,760 | B2 * | 8/2013 | Ikegami | H04M 1/72522 704/260 |
| 9,240,180 | B2 * | 1/2016 | Conkie | G10L 13/04 |
| 2001/0047260 | A1 * | 11/2001 | Walker | H04M 3/4938 704/260 |
| 2003/0223604 | A1 * | 12/2003 | Nakagawa | H04M 1/6066 381/311 |
| 2005/0138562 | A1 * | 6/2005 | Carro | G06F 3/04886 715/734 |
| 2005/0192061 | A1 | 9/2005 | May et al. | |
| 2006/0161426 | A1 * | 7/2006 | Ikegami | H04M 1/72522 704/201 |
| 2008/0235742 | A1 * | 9/2008 | Osaki | H04N 21/2387 725/100 |
| 2008/0279348 | A1 * | 11/2008 | Carro | G06F 3/04886 379/88.04 |
| 2009/0299746 | A1 | 12/2009 | Meng et al. | |
| 2010/0250253 | A1 * | 9/2010 | Shen | H04R 1/1041 704/260 |
| 2013/0144624 | A1 * | 6/2013 | Conkie | G10L 13/04 704/260 |
| 2014/0122080 | A1 | 5/2014 | Kaszczuk et al. | |

* cited by examiner

VOICE PROMPT GENERATION COMBINING NATIVE AND REMOTELY-GENERATED SPEECH DATA

I. FIELD OF THE DISCLOSURE

The present disclosure relates in general to providing voice prompts at a wireless device based on native and remotely-generated speech data.

II. BACKGROUND

A wireless device, such as a speaker or wireless headset, can interact with an electronic device to play music stored at the electronic device (e.g., a mobile phone). The wireless device can also output a voice prompt to identify a triggering event detected by the wireless device. For example, the wireless device outputs a voice prompt indicating that the wireless device has connected with the electronic device. To enable output of the voice prompt, pre-recorded (e.g., pre-packaged or "native") speech data is stored at a memory of the electronic device. Because the pre-recorded speech data is generated without knowledge of user specific information (e.g., contact names, user-configurations, etc.), providing natural-sounding and detailed voice prompts based on the pre-recorded speech data is difficult. To provide more detailed voice prompts, text-to-speech (TTS) conversion can be performed at the electronic device using a text prompt generated based on the triggering event. However, TTS conversion uses significant processing and power resources. To reduce resource consumption, TTS conversion can be offloaded to an external server. However, accessing the external server to convert each text prompt consumes power at the electronic device and uses an Internet connection each time. Additionally, quality of the Internet connection or a processing load at the server can disrupt or prevent completion of TTS conversion.

III. SUMMARY

Power consumption, use of processing resources, and network (e.g., Internet) use at an electronic device are reduced by selectively accessing a server to request TTS conversion of a text prompt and by storing received synthesized speech data at a memory of the electronic device. Because the synthesized speech data is stored at the memory, the server is accessed a single time to convert each unique text prompt, and if a same text prompt is to be converted into speech data in the future, the synthesized speech data is provided from the memory instead of being requested from the server (e.g., using network resources). In one implementation, an electronic device includes a processor and a memory coupled to the processor. The memory includes instructions that, when executed by the processor, cause the processor to perform operations. The operations include determining whether a text prompt received from a wireless device corresponds to first synthesized speech data stored at the memory. The operations include, in response to a determination that the text prompt does not correspond to the first synthesized speech data, determining whether a network is accessible. The operations include, in response to a determination that the network is accessible, sending a TTS conversion request to a server via the network. For example, the electronic device sends a TTS conversion request including the text prompt to a server configured to perform TTS conversion and to provide synthesized speech data. The operations further include, in response to receiving second synthesized speech data from the server, storing the second synthesized speech data at the memory. If the electronic device receives the same text prompt in the future, the electronic device provides the second synthesized speech data to the wireless device from the memory instead of requesting redundant TTS conversion from the server.

In a particular implementation, the operations further include providing the second synthesized speech data to the wireless device in response to a determination that the second synthesized speech data is received prior to expiration of a threshold time period. Alternatively, the operations further include providing pre-recorded speech data to the wireless device in response to a determination that the second synthesized speech data is not received prior to expiration of the threshold time period or a determination that the network is not accessible. In another implementation, the operations further include providing the first synthesized speech data to the wireless device in response to a determination that the text prompt corresponds to the first synthesized speech data. A voice prompt is output by the wireless device based on the respective synthesized speech data (e.g., the first synthesized speech data, the second synthesized speech data, or the third synthesized speech data) received from the electronic device.

In another implementation, a method includes determining whether a text prompt received at an electronic device from a wireless device corresponds to first synthesized speech data stored at a memory of the electronic device. The method includes, in response to a determination that the text prompt does not correspond to the first synthesized speech data, determining whether a network is accessible to the electronic device. The method includes, in response to a determination that the network is accessible, sending a text-to-speech (TTS) conversion request from the electronic device to a server via the network. The method further includes, in response to receiving second synthesized speech data from the server, storing the second synthesized speech data at the memory. In a particular implementation, the method further includes providing the second synthesized speech data to the wireless device in response to a determination that the second synthesized speech data is received prior to expiration of a threshold time period. In another implementation, the method further includes providing third synthesized speech data (e.g., pre-recorded speech data) corresponding to the text prompt to the wireless device, or displaying the text prompt at a display device if the third synthesized speech data does not correspond to the text prompt.

In another implementation, a system includes a wireless device and an electronic device configured to communicate with the wireless device. The electronic device is further configured to receive a text prompt based on a triggering event from the wireless device. The electronic device is further configured to send a text-to-speech (TTS) conversion request to a server via a network in response to a determination that the text prompt does not correspond to previously-stored synthesized speech data stored at a memory of the electronic device and a determination that the network is accessible to the electronic device. The electronic device is further configured to receive synthesized speech data from the server and to store the synthesized speech data at the memory. In a particular implementation, the electronic device is further configured to provide the synthesized speech data to the wireless device when the synthesized speech data is received prior to expiration of a threshold time period, and the wireless device is configured to output a voice prompt identifying the triggering event based on the synthesized speech data. In another implementation, the electronic device is further configured to provide pre-recorded speech data to the wireless device when the synthesized speech data is not received prior to expiration of a threshold time period or when the network is not accessible, and the wireless device is configured to output a voice prompt identifying a general event based on the pre-recorded speech data.

IV. BRIEF DESCRIPTION OF THE DRAWINGS

V. DETAILED DESCRIPTION

A system and method to provide synthesized speech data used to output voice prompts from an electronic device to a wireless device is described herein. The synthesized speech data includes pre-recorded (e.g., pre-packaged or "native") speech data stored at a memory of the electronic device and remotely-generated synthesized speech data received from a server configured to perform text-to-speech (TTS) conversion.

The electronic device receives a text prompt from the wireless device for TTS conversion. If previously-stored synthesized speech data (e.g., synthesized speech data received based on a previous TTS request) at the memory corresponds to the text prompt, the electronic device provides the previously-stored synthesized speech data to the wireless device to enable output of a voice prompt based on the previously-stored synthesized speech data. If the previously-stored synthesized speech data does not correspond to the text prompt, the electronic device determines whether a network is accessible and, if the network is accessible, sends a TTS request including the text prompt to a server via the network. The electronic device receives synthesized speech data from the server and stores the synthesized speech data at the memory. If the synthesized speech data is received prior to expiration of a threshold time period, the electronic device provides the synthesized speech data to the wireless device to enable output of a voice prompt based on the synthesized speech data.

If the synthesized speech data is not received prior to expiration of the threshold time period, or if the network is not accessible, the electronic device provides pre-recorded (e.g., pre-packaged or native) speech data to the wireless device to enable output of a voice prompt based on the pre-recorded speech data. In a particular implementation, a voice prompt based on the synthesized speech data is more informative (e.g., more detailed) than a voice prompt based on the pre-recorded speech data. Thus, a more-informative voice prompt is output at the wireless device when the synthesized speech data is received prior to expiration of the threshold time period, and a general (e.g., less detailed) voice prompt is output when the synthesized speech data is not received prior to expiration of the threshold time period. Because the synthesized speech data is stored at the memory, if a same text prompt is received by the electronic device in the future, the electronic device provides the synthesized speech data from the memory, thereby reducing power consumption and reliance on network access.

Figure 1:
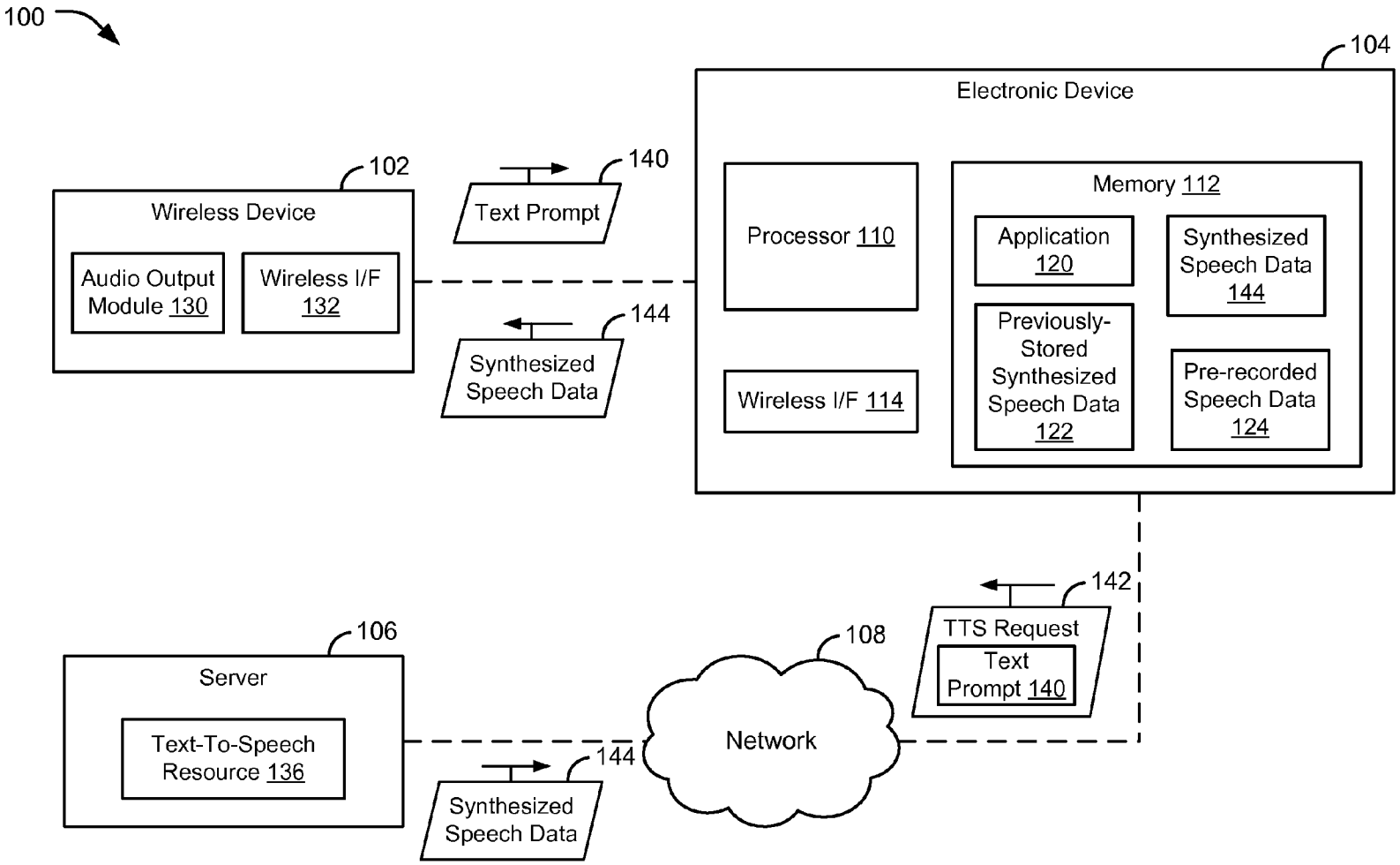
FIG. 1 is a diagram of an illustrative implementation of a system to enable output of voice prompts at a wireless device based on synthesized speech data from an electronic device.

Referring to FIG. 1, a diagram depicting an illustrative implementation of a system to enable output of voice prompts at a wireless device based on synthesized speech data from an electronic device is shown and generally designated 100. As shown in FIG. 1, the system 100 includes a wireless device 102 and an electronic device 104. The wireless device 102 includes an audio output module 130 and a wireless interface 132. The audio output module 130 enables audio output at the wireless device 102 and is implemented in hardware, software, or a combination of the two (e.g. a processing module and a memory, an application-specific integrated circuit (ASIC), a field-programmable gate array (FPGA), etc.). The electronic device 104 includes a processor 110 (e.g., a central processing unit (CPU), a digital signal processor (DSP), a network processing unit (NPU), etc.), a memory 112 (e.g., a static random access memory (SRAM), a dynamic random access memory (DRAM), a flash memory, a read-only memory (ROM), etc.), and a wireless interface 114. The various components illustrated in FIG. 1 are for example and not to be considered limiting. In alternate examples, more, fewer, or different components are included in the wireless device 102 and the electronic device 104.

The wireless device 102 is configured to transmit and to receive wireless signals in accordance with one or more wireless communication standards via the wireless interface 132. In a particular implementation, the wireless interface 132 is configured to communicate in accordance with a Bluetooth communication standard. In other implementations, the wireless interface 134 is configured to operate in accordance with one or more other wireless communication standards, such as an Institute of Electrical and Electronics Engineers (IEEE) 802.11 standard, as a non-limiting example. The wireless interface 114 of the electronic device 104 is similarly configured as the wireless interface 132, such that the wireless device 102 and the electronic device 104 communicate in accordance with the same wireless communication standard.

The wireless device 102 and the electronic device 104 are configured to perform wireless communications to enable audio output at the wireless device 102. In a particular implementation, the wireless device 102 and the electronic device 104 are part of a wireless music system. For example, the wireless device 102 is configured play music stored at or generated by the electronic device 104. In particular implementations, the wireless device 102 is a wireless speaker or a wireless headset, as non-limiting examples. In particular implementations, the electronic device 104 is a mobile telephone (e.g., a cellular phone, a satellite telephone, etc.) a computer system, a laptop computer, a tablet computer, a personal digital assistant (PDA), a wearable computer device, a multimedia device, or a combination thereof, as non-limiting examples.

To enable the electronic device 104 to interact with the wireless device 102, the memory 112 includes an application 120 (e.g., instructions or a software application) that is executable by the processor 110 to cause the electronic device 104 to perform one or more steps or methods to provide audio data to the wireless device 102. For example, the electronic device 104 (via execution of the application 120) transmits audio data corresponding to music stored at the memory 112 for playback via the wireless device 102.

In addition to providing playback of music, the wireless device 102 is further configured to output voice prompts based on triggering events. The voice prompts identify and provide information related to the triggering events to a user of the wireless device 102. For example, when the wireless device 102 is turned off, the wireless device 102 outputs a voice prompt (e.g., an audio rendering of speech) of the phrase "powering down." As another example, when the wireless device 102 is turned on, the wireless device 102 outputs a voice prompt of the phrase "powering on." For general (e.g., generic) triggering events, such as powering down or powering on, synthesized speech data is pre-recorded. However, a voice prompt based on the pre-recorded speech data can lack specific details related to the triggering event. For example, a voice prompt based on the pre-recorded data includes the phrase "connected to device" when the wireless device 102 connects with the electronic device 104. However, if the electronic device 104 is named "John's phone," it is desirable for the voice prompt to include the phrase "connecting to John's phone." Because the name of the electronic device 104 (e.g., "John's phone") is not known when the pre-recorded speech data is generated, providing such a voice prompt based on the pre-recorded speech data is difficult.

Thus, to provide a more informative voice prompt, text-to-speech (TTS) conversion is used. However, performing TTS conversion consumes power and uses significant processing resources, which is not desirable at the wireless device 102. To enable offloading of the TTS conversion, the wireless device 102 generates a text prompt 140 based on the triggering event and provides the text prompt to the electronic device 104. In a particular implementation, the text prompt 140 includes user-specific information, such as a name of the electronic device 104, as a non-limiting example.

The electronic device 104 is configured to receive the text prompt 140 from the wireless device 102 and to provide corresponding synthesized speech data based on the text prompt 140 to the wireless device 102. Although the text prompt 140 is described as being generated at the wireless device 102, in an alternative implementation, the text prompt 140 is generated at the electronic device 104. For example, the wireless device 102 transmits an indicator of the triggering event to the electronic device 104, and the electronic device 104 generates the text prompt 140. The text prompt 140 generated by the electronic device 104 includes additional user-specific information stored at the electronic device 104, such as a device name of the electronic device 104 or a name in a contact list stored in the memory 112, as non-limiting examples. In other implementations, the user-specific information is transmitted to the wireless device 102 for generation of the text prompt 140. In other implementations, the text prompt 140 is initially generated by the wireless device 102 and modified by the electronic device 104 to include the user specific information.

To reduce power consumption and use of processing resources associated with performing TTS conversion, the electronic device 104 is configured to access an external server 106 via a network 108 to request TTS conversion. In a particular implementation, a text-to-speech resource 136 (e.g., a TTS application) executed on one or more servers (e.g., the server 106) at a data center provides smooth, high quality synthesized speech data. For example, the server 106 is configured to generate synthesized speech data corresponding to a received text input. In a particular implementation, the network 108 is the Internet. In other implementations, the network 108 is a cellular network or a wide area network (WAN), as non-limiting examples. By offloading the TTS conversion to the server 106, processing resources at the electronic device 104 are available for performing other operations, and power consumption is reduced as compared to performing the TTS conversion at the electronic device 104.

However, requesting TTS conversion from the server 106 each time a text prompt is received consumes power, increases reliance on a network connection, and uses network resources (e.g., a data plan of the user) inefficiently. To more efficiently use network resources and to reduce power consumption, the electronic device 104 is configured to selectively access the server 106 to request TTS conversion a single time for each unique text prompt, and to use synthesized speech data stored at the memory 112 when a non-unique (e.g., a previously-converted) text prompt is received. To illustrate, the electronic device 104 is configured to send a TTS request 142 to the server 106 via the network 108 in response to a determination that the text prompt 140 does not correspond to previously-stored synthesized speech data 122 at the memory 112 and a determination that the network 108 is accessible. The determinations are described in further detail with reference to FIG. 2. The TTS request 142 includes the text prompt 140. The server 106 receives the TTS request 142 and generates synthesized speech data 144 based on the text prompt 140. The electronic device 104 receives the speech data 144 from the server 106 via the network 108 and stores the synthesized speech data 144 at the memory 112. If a subsequently received text prompt is the same as (e.g., matches) the text prompt 140, the electronic device 104 retrieves the synthesized speech data 144 from the memory 112 instead of sending a redundant TTS request to the server 106, thereby reducing use of network resources.

If the synthesized speech data 144 is not received at the wireless device 102 within a threshold time period, the user is able to perceive a voice prompt generated based on the synthesized speech data 144 as unnatural, or delayed. To reduce or prevent such a perception, the electronic device 104 is configured to determine whether the synthesized speech data 144 is received prior to expiration of the threshold time period. In a particular implementation, the threshold time period does not exceed 150 milliseconds (ms). In other implementations, the threshold time period has different values, such that the threshold time period is selected to reduce or prevent user perception of the voice prompt as unnatural or delayed. When the synthesized speech data 144 is received prior to expiration of the threshold time period, the electronic device 104 provides (e.g., transmits) the synthesized speech data 144 to the wireless device 102. Upon receipt of the synthesized speech data 144, the wireless device 102 outputs a voice prompt based on the synthesized speech data 144. The voice prompt identifies the triggering event. For example, the wireless device 102 outputs "connected to John's phone" based on the synthesized speech data 144.

When the synthesized speech data 144 is not received prior to expiration of the threshold time period or when the network 108 is not available, the electronic device 104 provides pre-recorded (e.g., pre-packaged or "native") speech data 124 from the memory 112 to the wireless device 102. The pre-recorded speech data 124 is provided with the application 120, and includes synthesized speech data corresponding to multiple phrases describing general events.

For example, the pre-recorded speech data 124 includes synthesized speech data corresponding to the phrases "powering up" or "powering down." As another non-limiting example, the pre-recorded speech data 124 includes synthesized speech data of the phrase "connected to device." In a particular implementation, the pre-recorded speech data 124 is generated using the text-to-speech resource 136, such that the user does not perceive a difference in quality between the pre-recorded speech data 124 and the synthesized speech data 144. Although the previously-stored synthesized speech data 122 and the pre-recorded speech data 124 are illustrated as stored in the memory 112, such illustration is for convenience and is not limiting. In other implementations, the previously-stored synthesized speech data 122 and the pre-recorded speech data 124 are stored in a database accessible to the electronic device 104.

The electronic device 104 selects synthesized speech data corresponding to a pre-recorded phrase from the pre-recorded speech data 124 based on the text prompt 140. For example, when the text prompt 140 includes text data of the phrase "connected to John's phone," the electronic device 104 selects synthesized speech data corresponding to the pre-recorded phrase "connected to device" from the pre-recorded speech data 124. The electronic device 104 provides the selected pre-recorded speech data 124 (e.g., the pre-recorded phrase) to the wireless device 102. Upon receipt of the pre-recorded speech data 124 (e.g., the pre-recorded phrase), the wireless device 102 outputs a voice prompt based on the pre-recorded speech data 124. The voice prompt identifies a general event corresponding to the triggering event, or describes the triggering event with less detail than a voice prompt based on the synthesized speech data 144. For example, the wireless device 102 outputs a voice prompt of the phrase "connected to device," as compared to a voice prompt of the phrase "connected to John's phone."

During operation, when a triggering event occurs, the electronic device 104 receives the text prompt 140 from the wireless device 102. If the text prompt 140 has been previously converted (e.g., the text prompt 140 corresponds to the previously-stored synthesized speech data 122), the electronic device 104 provides the previously-stored synthesized speech data 122 to the wireless device 102. If the text prompt 140 does not correspond to the previously-stored synthesized speech data 122 and the network 108 is available, the electronic device 104 sends the TTS request 142 to the server 106 via the network 108 and receives the synthesized speech data 144. If the synthesized speech data 144 is received prior to expiration of the threshold time period, the electronic device 104 provides the synthesized speech data 144 to the wireless device 102. If the synthesized speech data 144 is not received prior to expiration of the threshold time period, or if the network 108 is not available, the electronic device provides the pre-recorded speech data 124 to the wireless device 102. The wireless device 102 outputs a voice prompt based on the synthesized speech data received from the electronic device 104. In a particular implementation, the wireless device 102 generates other audio outputs (e.g., sounds) when voice prompts are disabled, as further described with reference to FIG. 3.

By offloading the TTS conversion from the wireless device 102 and the electronic device 104 to the server 106, the system 100 enables generation of synthesized speech data having a consistent quality level while reducing processing complexity and power consumption at the wireless device 102 and the electronic device 104. Additionally, by requesting TTS conversion a single time for each unique text prompt and storing the corresponding synthesized speech data at the memory 112, network resources are used more efficiently as compared to requesting TTS conversion each time a text prompt is received, even if the text prompt has been previously converted. Further, by using pre-recorded speech data 124 when the network 108 is unavailable or when the synthesized speech data 144 is not received prior to expiration of the threshold time period, the electronic device 104 enables output of at least a general (e.g., less detailed) voice prompt when a more informative (e.g., more detailed) voice prompt is unavailable.

Figure 2:
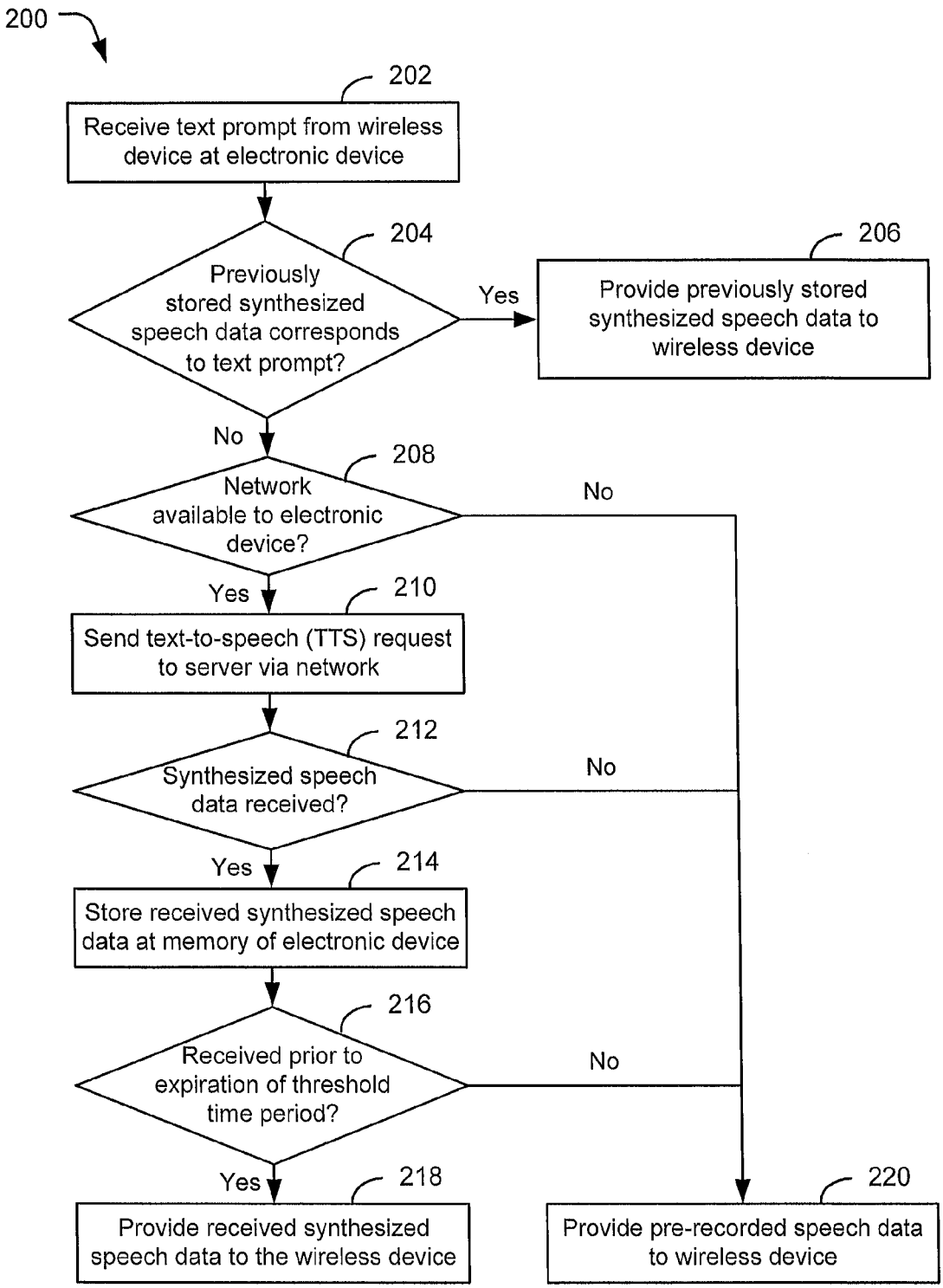
FIG. 2 is a flow chart of an illustrative implementation of a method of providing speech data from the electronic device to the wireless device of FIG. 1.

FIG. 2 illustrates an illustrative implementation of a method 200 of providing speech data from the electronic device 104 to the wireless device 102 of FIG. 1. For example, the method 200 is performed by the electronic device 104. The speech data provided from the electronic device 104 to the wireless device 102 is used to generate a voice prompt at the wireless device, as described with reference to FIG. 1.

The method 200 begins and the electronic device 104 receives a text prompt (e.g., the text prompt 140) from the wireless device 102, at 202. The text prompt 140 includes information identifying a triggering event detected by the wireless device 102. As described herein with reference to FIG. 2, the text prompt 140 includes the text string (e.g., phrase) "connected to John's phone."

The previously-stored synthesized speech data 122 is compared to the text prompt 140, at 204, to determine whether the text prompt 140 corresponds to the previously-stored synthesized speech data 122. For example, the previously-stored synthesized speech data 122 includes synthesized speech data corresponding to one or more previously-converted phrases (e.g., results of previous TTS requests sent to the server 106). The electronic device 104 determines whether the text prompt 140 is the same as the one or more previously-converted phrases. In a particular implementation, the electronic device 104 is configured to generate an index (e.g., an identifier or hash value) associated with each text prompt. The indices are stored with the previously-stored synthesized speech data 122. In this particular implementation, the electronic device 104 generates an index corresponding to the text prompt 140 and compares the index to the indices of the previously-stored synthesized speech data 122. If a match is found, the electronic device 104 determines that the previously-stored synthesized speech data 122 corresponds to the text prompt 140 (e.g., that the text prompt 140 has been previously converted into synthesized speech data). If no match is found, the electronic device 104 determines that the previously-stored synthesized speech data 122 does not correspond to the text prompt 140 (e.g., that the text prompt 140 has not been previously converted into synthesized speech data). In other implementations, the determination whether the previously-stored synthesized speech data 122 corresponds to the text prompt 140 are performed in a different manner.

If the previously-stored synthesized speech data 122 corresponds to the text prompt 140, the method 200 continues to 206, where the previously-stored synthesized speech data 122 (e.g., a matching previously-converted phrase) is provided to the wireless device 102. If the previously-stored synthesized speech data 122 does not correspond to the text prompt 140, the method 200 continues to 208, where the electronic device 104 determines whether the network 108 is available. In a particular implementation, when the network 108 corresponds to the Internet, the electronic device 104 determines whether a connection with the Internet is detected (e.g., available). In other implementations, the electronic device 104 detects other network connections, such as a cellular network connection or a WAN connection, as non-limiting examples. If the network 108 is not available, the method 200 continues to 220, as further described below.

Where the network 108 is available (e.g., if a connection to the network 108 is detected by the electronic device 104), the method 200 continues to 210. The electronic device 104 transmits the TTS request 142 to the server 106 via the network 108, at 210. The TTS request 142 is formatted in accordance with the TTS resource 136 running at the server 106 and includes the text prompt 140. The server 106 receives the TTS request 142 (including the text prompt 14), generates the synthesized speech data 144, and transmits the synthesized speech data 144 to the electronic device 104 via the network 108. The electronic device 104 determines whether the synthesized speech data 144 has been received from the server 106, at 212. If the synthesized speech data 144 is not received at the electronic device 104, the method 200 continues to 220, as further described below.

If the synthesized speech data 144 is received at the electronic device 104, the method 200 continues to 214, where the electronic device 104 stores the synthesized speech data 144 in the memory 112. Storing the synthesized speech data 144 enables the electronic device 104 to provide the synthesized speech data 144 from the memory 112 when the electronic device 104 receives a text prompt that is the same as the text prompt 140.

The electronic device 104 determines whether the synthesized speech data 144 is received prior to expiration of a threshold time period, at 218. In a particular implementation, the threshold time period is less than or equal to 150 ms and is a maximum time period before the user perceives a voice prompt as unnatural or delayed. In another particular implementation, the electronic device 104 includes a timer or other timing logic configured to track an amount of time between receipt of the text prompt 140 and receipt of the synthesized speech data 144. If the synthesized speech data 144 is received prior to expiration of the threshold time period, the method 200 continues to 218, where the electronic device provides the synthesized speech data 144 to the wireless device 102. If the synthesized speech data 144 is not received prior to expiration of the threshold time period, the method 200 continues to 220.

The electronic device 104 provides the pre-recorded speech data 124 to the wireless device 102, at 220. For example, if the network 108 is not available, if the synthesized speech data 144 is not received, or if the synthesized speech data 144 is not received prior to expiration of the threshold time period, the electronic device 104 provides the pre-recorded speech data 124 to the wireless device 102 so that the wireless device 102 is able to output a voice prompt without the user perceiving a delay. Because the synthesized speech data 144 is not available, the electronic device 104 provides the pre-recorded speech data 124. In a particular implementation, the pre-recorded speech data 124 includes synthesized speech data corresponding to multiple pre-recorded phrases describing general events (e.g., pre-recorded phrases contain less information than the text prompt 140). The electronic device 104 selects a particular pre-recorded phrase from t the pre-recorded speech data 124 to provide to the wireless device 102 based on the text prompt 140. For example, based on the text prompt 140 (e.g., "connected to John's phone"), the electronic device selects the pre-recorded phrase "connected to device" from the pre-recorded speech data 124 for providing to the wireless device 102.

The synthesized speech data 144 is stored in the memory 112 even if the synthesized speech data 144 is received after expiration of the threshold time period. Thus, the electronic device 104 provides the pre-recorded speech data 124 to the wireless device 102 a single time. If the electronic device 104 later receives a same text prompt as the text prompt 140, the electronic device 104 provides the synthesized speech data 144 from the memory 112 instead of sending a redundant TTS request to the server 106.

The method 200 enables the electronic device 104 to reduce power consumption and more efficiently use network resources by sending a TTS request to the server 106 a single time for each unique text prompt. Additionally, the method 200 enables the electronic device 104 to provide the pre-recorded speech data 124 to the wireless device 102 when synthesized speech data has not been previously stored at the memory 112 or received from the server 106. Thus, the wireless device 102 receives speech data corresponding to at least a general speech phrase in response to each text prompt.

Figure 3:
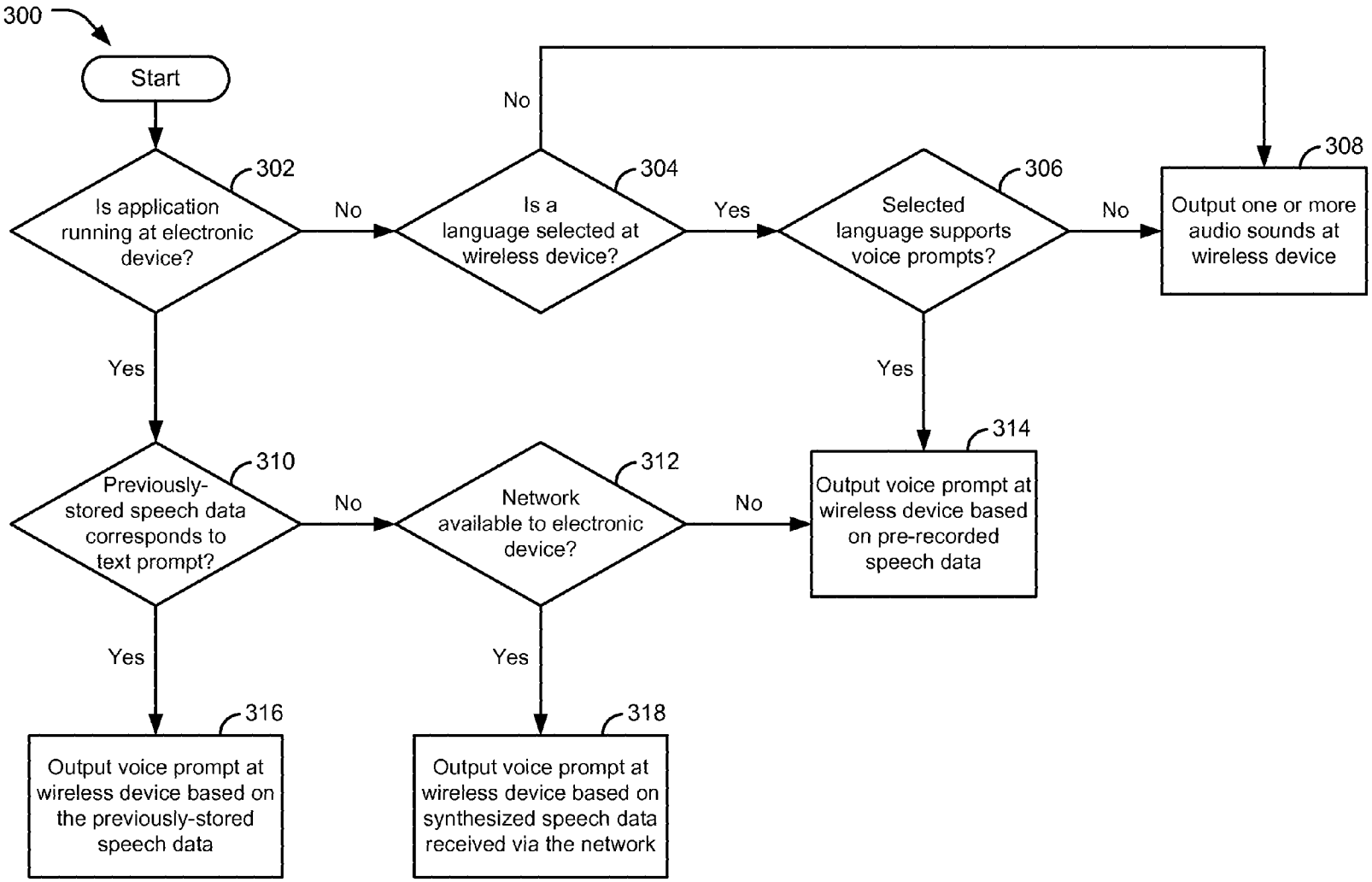
FIG. 3 is a flow chart of an illustrative implementation of a method of generating audio outputs at the wireless device of FIG. 1.

FIG. 3 illustrates an illustrative implementation of a method 300 of generating audio outputs at the wireless device 102 of FIG. 1. The method 300 enables generation of voice prompts or other audio outputs at the wireless device 102 to identify triggering events.

The method 300 starts when a triggering event is detected by the wireless device 102. The wireless device 102 generates a text prompt (e.g., the text prompt 140) based on the triggering event. The wireless device 102 determines whether the application 120 is running at the electronic device 104, at 302. For example, the wireless device 102 determines whether the electronic device 104 is powered on and running the application 120, such as by sending an acknowledgement request or other message to the electronic device 104, as a non-limiting example. If the application 120 is running at the electronic device 104, the method 300 continues to 310, as further described below.

If the application 120 is not running at the electronic device 104, the method 300 continues to 304, where the wireless device 102 determines whether a language is selected at the wireless device 102. For example, the wireless device 102 is be configured to output information in multiple languages, such as English, Spanish, French, and German, as non-limiting examples. In a particular implementation, a user of the wireless device 102 selects a particular language for the wireless device 102 to generate audio (e.g., speech). In other implementations, a default language is pre-programmed into the wireless device 102.

Where the language is not selected, the method 300 continues to 308, where the wireless device 102 outputs one or more audio sounds (e.g., tones) at the wireless device 102. The one or more audio sounds identify the triggering event. For example, the wireless device 102 outputs a series of beeps to indicate that the wireless device 102 has connected to the electronic device 104. As another example, the wireless device 102 outputs a single, longer beep to indicate that the wireless device 102 is powering down. In a particular implementation, the one or more audio sounds are generated based on audio data stored at the wireless device 102.

If the language is selected, the method 300 continues to 306, where the wireless device 102 determines whether the selected language supports voice prompts. In a particular example, the wireless device 102 does not support voice prompts in a particular language due to lack of TTS conversion resources for the particular language. If the wireless device 102 determines that the selected language does not support voice prompts, the method 300 continues to 308, where the wireless device 102 outputs one or more audio sounds to identify the triggering event, as described above.

Where the wireless device 102 determines that the selected language supports voice prompts, the method 300 continues to 314, where the wireless device 102 outputs a voice prompt based on pre-recorded speech data (e.g., the pre-recorded speech data 124). As described above, the pre-recorded speech data 124 includes synthesized speech data corresponding to multiple pre-recorded phrases. The wireless device 102 selects a pre-recorded phrase from the pre-recorded speech data 124 based on the text prompt 140 and outputs a voice prompt based on the pre-recorded speech data 124 (e.g., the pre-recorded phrase). In a particular implementation, at least a subset of the pre-recorded speech data 124 is stored at the wireless device 102, such that the wireless device 102 has access to the pre-recorded speech data 124 even when the application 120 is not running at the electronic device 104. In another implementation, in response to a determination that the text prompt 140 does not correspond to any speech phrase of the pre-recorded speech data 124, the wireless device 102 outputs one or more audio sounds to identify the triggering event, as described with reference to 308.

Where the application 120 is running at the electronic device 104, at 302, the method 300 continues to 310, where the electronic device 104 determines whether previously-stored speech data (e.g., the previously-stored synthesized speech data 122) corresponds to the text prompt 140. As described above, the previously-stored synthesized speech data 122 includes one or more previously-converted phrases. The electronic device 104 determines whether the text prompt 140 corresponds to (e.g., matches) the one or more previously-converted phrases.

In response to a determination that the text prompt 140 corresponds to the previously-stored synthesized speech data 122, the method 300 continues to 316, where the wireless device 102 outputs a voice prompt based on the previously-stored synthesized speech data 122. For example, the electronic device 104 provides the previously-stored stored speech data 122 (e.g., the previously-converted phrase) to the wireless device 102, and the wireless device 102 outputs the voice prompt based on the previously-converted speech phrase.

In response to a determination that the text prompt 140 does not correspond to the previously-stored synthesized speech data 122, the method 300 continues to 312, where the electronic device 104 determines whether a network (e.g., the network 108) is accessible. For example, the electronic device 104 determines whether a connection to the network 108 exists and is usable by the electronic device 104.

Where the network 108 is available, the method 300 continues to 318, where the wireless device 102 outputs a voice prompt based on synthesized speech data (e.g., the synthesized speech data 144) received via the network 108. For example, the electronic device 104 sends the TTS request 142 (including the text prompt 140) to the server 106 via the network 108 and receives the synthesized speech data 144 from the server 106. The electronic device 104 provides the synthesized speech data 144 to the wireless device 102, and the wireless device 102 outputs the voice prompt based on the synthesized speech data 144.

In response to a determination that the network 108 is not available, the method 300 continues to 314, where the wireless device 102 outputs a voice prompt based on the pre-recorded speech data 124. For example, the electronic device 104 selects a pre-recorded phrase from the pre-recorded speech data 124 based on the text prompt 140 and provides the pre-recorded speech data 124 (e.g., the pre-recorded phrase) to the wireless device 102. The wireless device 102 outputs the voice prompt based on the pre-recorded speech data 124 (e.g., the pre-recorded phrase). In a particular implementation, the electronic device 104 does not provide the pre-recorded speech data 124 to the wireless device 102 in response to a determination that the text prompt 140 does not correspond to the pre-recorded speech data 124. In this implementation, the electronic device 104 displays the text prompt 140 via a display device of the electronic device 104. In other implementations, the wireless device 102 outputs one or more audio sounds to identify the triggering event, as described above with reference to 308, or outputs the one or more audio sounds and displays the text prompt via the display device.

The method 300 enables the wireless device 102 to generate an audio output (e.g., the one or more audio sounds or a voice prompt) to identify a triggering event. The audio output is voice prompt if voice prompts are enabled. Additionally, the voice prompt is based on pre-recorded speech data or synthesized speech data representing TTS conversion of a text prompt (depending on availability of the synthesized speech data). Thus, the method 300 enables the wireless device 102 to generate an audio output to identify the triggering event with as much detail as available.

Figure 4:
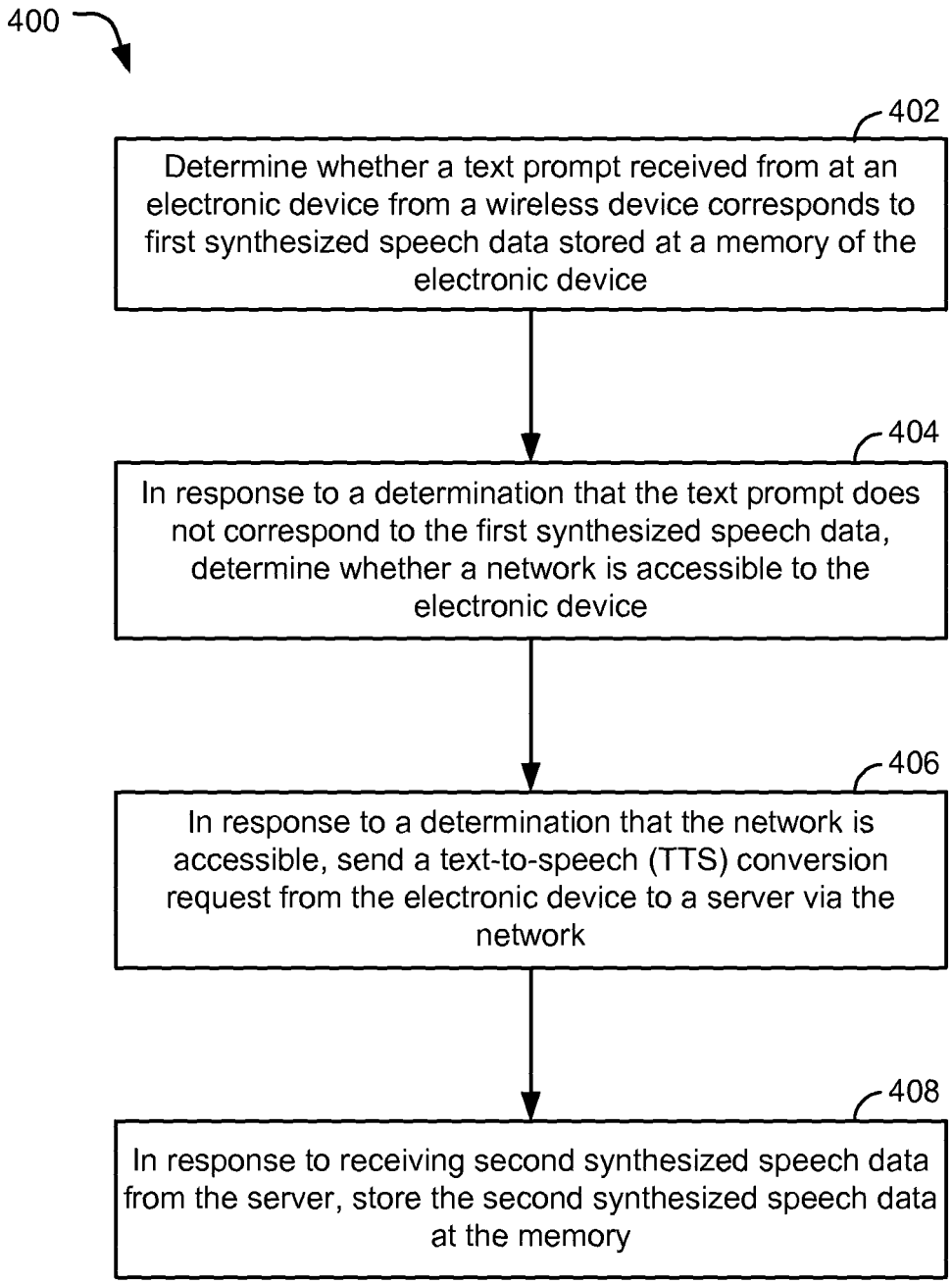
FIG. 4 is a flowchart of an illustrative implementation of a method of selectively requesting synthesized speech data via a network.

FIG. 4 illustrates an illustrative implementation of a method 400 of selectively requesting synthesized speech data via a network. In a particular implementation, the method 400 is performed at the electronic device 104 of FIG. 1. A determination whether a text prompt received at an electronic device from a wireless device corresponds to first synthesized speech data stored at a memory of the electronic device is performed, at 402. For example, the electronic device 104 determines whether the text prompt 140 received from the wireless device 102 corresponds to the previously-stored synthesized speech data 122.

In response to a determination that the text prompt does not correspond to the first synthesized speech data, a determination whether a network is accessible to the electronic device is performed, at 404. For example, in response to a determination that the text prompt 140 does not correspond to the previously-stored synthesized speech data 122, the electronic device 104 determines whether the network 108 is accessible.

In response to a determination that the network is accessible, a text-to-speech (TTS) conversion request is sent from the electronic device to a server via the network, at 406. For example, in response to a determination that the network 108 is accessible, the electronic device 104 sends the TTS request 142 (including the text prompt 140) to the server 106 via the network 108.

In response to receipt of second synthesized speech data from the server, the second synthesized speech data is stored at the memory, at 408. For example, in response to receiving the synthesized speech data 144 from the server 106, the electronic device 104 stores the synthesized speech data 144 at the memory 112. In a specific implementation, the server is configured to generate the second synthesized speech data (e.g., the synthesized speech data 144) based on the text prompt included in the TTS conversion request.

In a particular implementation, the method 400 further includes, in response to a determination that the second synthesized speech data is received prior to expiration of a threshold time period, providing the second synthesized speech data to the wireless device. For example, in response to a determination that the synthesized speech data 144 is received prior to expiration of the threshold time period, the electronic device 104 provides the synthesized speech data 144 to the wireless device 102. The method 400 can further include determining whether the second synthesized speech data is received prior to expiration of the threshold time period. For example, the electronic device 104 determines whether the synthesized speech data 144 is received from the server 106 prior to expiration of the threshold time period. In a particular implementation, the threshold time period does not exceed 150 milliseconds.

In another implementation, the method 400 further includes, in response to a determination that the network is not accessible or a determination that the second synthesized speech data is not received prior to expiration of a threshold time period, determining whether third synthesized speech data stored at the memory corresponds to the text prompt. The third synthesized speech data includes pre-recorded speech data. In a particular implementation, the second synthesized speech data includes more information than the third synthesized speech data. For example, in response to a determination that the network 108 is not accessible or a determination that the synthesized speech data 144 is not received prior to expiration of the threshold time period, the electronic device 104 determines whether the pre-recorded speech data 124 stored at the memory 112 corresponds to the text prompt 140. The synthesized speech data 144 includes more information than the pre-recorded speech data 124.

The method 400 can further include, in response to a determination that the third synthesized speech data corresponds to the text prompt, providing the third synthesized speech data to the wireless device. For example, in response to a determination that the pre-recorded speech data 124 corresponds to the text prompt 140, the electronic device 104 provides the pre-recorded speech data 124 to the wireless device 102. The method 400 can further include selecting the third synthesized speech data from a plurality of synthesized speech data stored at the memory based on the text prompt. For example, the electronic device 104 selects particular synthesized speech data (e.g., a particular phrase) from a plurality of synthesized speech data in the previously-stored synthesized speech data 122 based on the text prompt 140. In an alternative implementation, the method 400 further includes, in response to a determination that the third synthesized speech data does not correspond to the text prompt, displaying the text prompt at a display of the electronic device. For example, in response to a determination that the pre-recorded speech data 124 does not correspond to the text prompt 140, the electronic device 104 displays the text prompt 140 at a display of the electronic device 104.

In another implementation, the method 400 further includes, in response to a determination that the text prompt corresponds to the first synthesized speech data, providing the first synthesized speech data to the wireless device. For example, in response to a determination that the text prompt 140 corresponds to the previously-stored synthesized speech data 122, the electronic device 104 provides the previously-stored synthesized speech data 122 to the wireless device 102. The first synthesized speech data is associated with a previous TTS conversion request sent to the server. For example, the previously-stored synthesized speech data 122 is associated with a previous TTS request sent to the server 106.

The method 400 reduces power consumption of the electronic device 104 and reliance on network resources by reducing a number of times the server 106 is accessed for each unique text prompt to a single time. Thus, the electronic device 104 does not consume power and use network resources to request TTS conversion of a text prompt that has previously been converted into synthesized speech data via the server 106.

Implementations of the apparatus and techniques described above comprise computer components and computer-implemented steps that will be apparent to those skilled in the art. For example, it should be understood by one of skill in the art that the computer-implemented steps can be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions can be executed on a variety of processors such as, for example, microprocessors, digital signal processors, gate arrays, etc. For ease of description, not every step or element of the systems and methods described above is described herein as part of a computer system, but those skilled in the art will recognize that each step or element can have a corresponding computer system or software component. Such computer system and/or software components are therefore enabled by describing their corresponding steps or elements (that is, their functionality) and are within the scope of the disclosure.

Those skilled in the art can make numerous uses and modifications of and departures from the apparatus and techniques disclosed herein without departing from the inventive concepts. For example, selected examples of wireless devices and/or electronic devices in accordance with the present disclosure can include all, fewer, or different components than those described with reference to one or more of the preceding figures. The disclosed examples should be construed as embracing each and every novel feature and novel combination of features present in or possessed by the apparatus and techniques disclosed herein and limited only by the scope of the appended claims, and equivalents thereof.

What is claimed is:

1. An electronic device comprising:

a processor; and a memory coupled to the processor, the memory storing instructions that, when executed by the processor, cause the processor to perform operations comprising:

determining whether a text prompt received from a wireless device corresponds to first synthesized speech data stored at the memory;

in response to a determination that the text prompt does not correspond to the first synthesized speech data, determining whether a network is accessible;

in response to a determination that the network is accessible, sending a text-to-speech (TTS) conversion request to a server via the network; and in response to receiving second synthesized speech data from the server, storing the second synthesized speech data at the memory.

2. The electronic device of claim 1, wherein the operations further comprise determining whether the second synthesized speech data is received prior to expiration of a threshold time period.

3. The electronic device of claim 2, wherein the operations further comprise, in response to a determination that the second synthesized speech data is received prior to expiration of the threshold time period, providing the second synthesized speech data to the wireless device.

4. The electronic device of claim 2, wherein the threshold time period does not exceed 150 milliseconds.

5. The electronic device of claim 2, wherein the operations further comprise, in response to a determination that the second synthesized speech data is not received prior to expiration of the threshold time period, providing third synthesized speech data stored at the memory to the wireless device.

6. The electronic device of claim 5, wherein the third synthesized speech data includes pre-recorded speech data, and wherein the second synthesized speech data includes more information than the third synthesized speech data.

7. The electronic device of claim 1, wherein the operations further comprise, in response to a determination that the text prompt corresponds to the first synthesized speech data, providing the first synthesized speech data to the wireless device.

8. The electronic device of claim 7, wherein the first synthesized speech data is associated with a previous TTS conversion request sent to the server.

9. The electronic device of claim 1, wherein the operations further comprise, in response to a determination that the network is not accessible, providing third synthesized speech data stored at the memory to the wireless device.

10. The electronic device of claim 9, wherein the operations further comprise selecting the third synthesized speech data from a plurality of synthesized speech data stored at the memory based on the text prompt, and wherein the third synthesized speech data includes pre-recorded speech data.

11. A method comprising:

determining whether a text prompt received at an electronic device from a wireless device corresponds to first synthesized speech data stored at a memory of the electronic device;

in response to a determination that the text prompt does not correspond to the first synthesized speech data, determining whether a network is accessible to the electronic device;

in response to a determination that the network is accessible, sending a text-to-speech (TTS) conversion request from the electronic device to a server via the network; and in response to receiving second synthesized speech data from the server, storing the second synthesized speech data at the memory.

12. The method of claim 11, further comprising, in response to a determination that the second synthesized speech data is received prior to expiration of a threshold time period, providing the second synthesized speech data to the wireless device.

13. The method of claim 11, further comprising, in response to a determination that the network is not accessible or a determination that the second synthesized speech data is not received prior to expiration of a threshold time period, determining whether third synthesized speech data stored at the memory corresponds to the text prompt, wherein the third synthesized speech data includes pre-recorded speech data.

14. The method of claim 13, further comprising, in response to a determination that the third synthesized speech data corresponds to the text prompt, providing the third synthesized speech data to the wireless device.

15. The method of claim 13, further comprising, in response to a determination that the third synthesized speech data does not correspond to the text prompt, displaying the text prompt at a display of the electronic device.

16. A system comprising:

a wireless device; and an electronic device configured to communicate with the wireless device, wherein the electronic device is further configured to:

receive a text prompt based on a triggering event from the wireless device;

send a text-to-speech (TTS) conversion request to a server via a network in response to a determination that the text prompt does not correspond to previously-stored synthesized speech data at a memory of the electronic device and a determination that the network is accessible to the electronic device; and receive synthesized speech data from the server and store the synthesized speech data at the memory.

17. The system of claim 16, wherein the wireless device includes a wireless speaker or a wireless headset.

18. The system of claim 16, wherein the electronic device is further configured to provide the synthesized speech data to the wireless device when the synthesized speech data is received prior to expiration of a threshold time period, and wherein the wireless device is configured to output of a voice prompt based on the synthesized speech data, the voice prompt identifying the triggering event.

19. The system of claim 16, wherein the electronic device is further configured to provide pre-recorded speech data to the wireless device when the synthesized speech data is not received prior to expiration of a threshold time period or when the network is not accessible, and wherein the wireless device is configured to output of a voice prompt based on the pre-recorded speech data, the voice prompt identifying a general event corresponding to the triggering event.

20. The system of claim 16, wherein the wireless device is configured to output one or more audio sounds corresponding to the triggering event in response to a determination that voice prompts are disabled at the wireless device.

* * * * *